US006082449A

United States Patent [19]

Yamaguchi et al.

[11] Patent Number: 6,082,449

[45] Date of Patent: Jul. 4, 2000

[54] OIL COOLER STRUCTURE

[75] Inventors: Takeshi Yamaguchi; Yuji Yamai; Yoshinobu Okuno, all of Tokyo, Japan

[73] Assignee: Calsonic Corporation, Tokyo, Japan

[21] Appl. No.: 09/237,838

[22] Filed: Jan. 27, 1999

[30] Foreign Application Priority Data

| | | | |
|---|---|---|---|
| Jan. 27, 1998 | [JP] | Japan | 10-014142 |
| Apr. 14, 1998 | [JP] | Japan | 10-102779 |
| Nov. 11, 1998 | [JP] | Japan | 10-320526 |

[51] Int. Cl.[7] ..... F28F 3/00; F28F 3/02

[52] U.S. Cl. ..... 165/916; 165/166; 165/167; 165/174

[58] Field of Search ..... 165/916, 166, 165/167, 174

[56] References Cited

U.S. PATENT DOCUMENTS

| | | | |
|---|---|---|---|
| 4,201,263 | 5/1980 | Anderson | 165/166 |
| 5,016,707 | 5/1991 | Nguyen | 165/166 |
| 5,036,911 | 8/1991 | So et al. | 165/916 |
| 5,511,612 | 4/1996 | Tajima et al. | 165/916 |

FOREIGN PATENT DOCUMENTS

| | | | |
|---|---|---|---|
| 0214000 | 9/1991 | Japan | 165/167 |
| 403213999 | 9/1991 | Japan | 165/167 |
| 404043295 | 9/1991 | Japan | 165/167 |

*Primary Examiner*—Ira S. Lazarus
*Assistant Examiner*—Tho Duong
*Attorney, Agent, or Firm*—Foley & Lardner

[57] ABSTRACT

A structure for mounting an oil cooler to a heat-exchanger tank is disclosed. A long-scale oil cooler is received in a heat-exchanger tank, and pipe portions are formed only on one side of the oil cooler so that the pipe portions are inserted respectively in pipe holes formed in the tank. A support portion for supporting the other side of the oil cooler where no pipe portion is formed is formed on an inner surface of the tank. Further, a laminate type oil cooler is provided. The oil cooler has a core portion in which a plurality of shells each having an oil flow path formed therein are laminated. A first oil passage hole is formed at a first side end of the core portion, and a second oil passage hole is formed at a second side end of the core portion. The laminated shells are made to communicate with each other by the first and second oil passage holes. Further, a third oil passage hole is formed between the first oil passage hold and the second oil passage hole in a width direction of the core portion. Only a part of all laminated shells in a lamination direction of the shells are made to communicate with each other by the third oil passage hole. Further, a blocking member is disposed in the oil flow path of the shell having the third oil passage hole so as to block oil flow, the blocking member being disposed between the third oil passage hole and the first oil passage hole.

2 Claims, 17 Drawing Sheets

OIL COOLER STRUCTURE

BACKGROUND OF THE INVENTION

1. Field of the Invention

The present invention relates to a mounting structure for mounting an oil cooler to a heat exchanger tank and a structure of a laminate type oil cooler in which a plurality of shells each having an oil flow path formed therein are laminated.

The present application is based on Japanese Patent Applications No. Hei. 10-14142, Hei. 10-102779 and Hei 10-320526, which are incorporated herein by reference.

2. Description of the Related Art

For example, an oil cooler-containing radiator disclosed in Japanese Utility Model Publication No. 4-121427, or the like, is heretofore known as an oil cooler-containing radiator in which an oil cooler is received in a radiator tank.

FIG. 8 shows an oil cooler mounting structure in this type oil cooler-containing radiator. In the mounting structure, a long-scale oil cooler 202 is received in a tank 201.

An oil inlet pipe 203 and an oil outlet pipe 204 are disposed on opposite sides of the oil cooler 202. These pipes 203 and 204 are inserted respectively in pipe holes 201*a* and 201*b* formed in the tank 201.

Further, these pipes 203 and 204 are fixed to the tank 201 through O-rings 205 by nuts 206, so that the oil cooler 202 is fixed to the tank 201.

On the other hand, in view of piping, an oil cooler in which an oil inlet pipe 203 and an oil outlet pipe 204 are disposed on one side of a long-scale oil cooler 207 as shown in FIG. 9 has been developed recently.

Incidentally, for example, an oil cooler disclosed in Japanese Patent Publication No. Hei. 6-88527 is known as the aforementioned oil cooler.

In such an oil cooler 207, however, an oil inlet pipe 204 and an oil outlet pipe 204 are disposed on one side of along-scale oil cooler 207 so that these pipes 203 and 204 are inserted respectively in pipe holes 201*a* and 201*b* formed in a tank 201 and are fixed to the tank 201 by means of the nuts 206 to thereby fix the oil cooler 207 to the tank 201. Accordingly, the oil cooler 207 vibrates because of the vibration of the tank 201. There is therefore a risk that the other side of the oil cooler 207 on which the pipes 203 and 204 are not disposed may collide with the tank 201, or the like, so as to be broken.

Further, as an oil cooler for a car, there is heretofore known a laminate type oil cooler in which a plurality of shells each having an oil flow path formed between a pair of plate members are laminated, for example, as disclosed in FIG. 25.

FIG. 25 shows a laminate type oil cooler of this type. In FIG. 25, the reference numeral 101 designates shells each of which has an oil flow path 104 formed between a first plate member 102 and a second plate member 103.

The oil flow path 104 in each of the shells 101 receives an inner fin 105.

These shells 101 are laminated in a plurality of layers to thereby form a core portion 106.

Oil passage holes 107 are formed in these shells 101 so as to be disposed at a predetermined interval longitudinally.

As one side of the core portion 106, an oil inflow connector 108 and an oil outflow connector 109 are connected to the oil passage holes 107 in the first plate member 102 respectively.

Further, at the other side of the core portion 106, patch members 110 are disposed so as to cover the oil passage holes 107 in the second plate member 103.

In the aforementioned laminate type oil cooler, oil poured in from the oil inflow connector 108 flows into the oil flow paths 104 of the respective shells 101 through the oil passage holes 107. When the oil passes through the oil flow paths 104, heat exchange is performed between the oil and an external fluid. Then, the oil passes through the other-side oil passage hole 108 so as to flow out from the oil outflow connector 109.

In the aforementioned laminate type oil cooler, however, the oil inflow connector 108 is disposed on one side of the core portion 106 and the oil outflow connector 109 is disposed on the other side of the core portion 106. Accordingly, as the length of the core portion 106 increases, the distance L between the oil inflow connector 108 and the oil outflow connector 109 increases, for example, to about 400 mm. There was a problem that the piping of pipes 111 and 112, which are connected to the oil inflow and outflow connectors 108 and 109 respectively, to the vehicle side became complicated.

SUMMARY OF THE INVENTION

The present invention is designed to solve the above problems. An object of the present invention is to provide a structure for mounting an oil cooler to a heat exchanger tank so that the oil cooler can be supported to the tank securely even in the case where pipes are disposed only on one side of the oil cooler.

It is another object of the present invention is to provide a laminate type oil cooler in which an oil inflow connector and an oil outflow connector can be disposed on one side of a core portion easily so as to be close to each other.

According to one aspect of the present invention, a structure for mounting a long-scale oil cooler to a heat exchanger tank is provided. In the structure, a pipe portion is formed only on a first side of the long-scale oil cooler, and a pipe hole is formed in the heat exchanger tank, the pipe portion of the long-scale oil cooler is inserted into the pipe hole so that the long-scale oil cooler is received in the heat exchanger tank. Further, a support portion is formed on an inner surface of the heat exchanger tank so as to support a second side of the long-scale oil cooler in which no pipe portion is formed.

In a preferred embodiment in the above structure, a protrusion portion is formed on the second side of the oil cooler, the protrusion portion is fitted to the support portion.

According to another aspect of the present invention, there is provided a laminate type oil cooler. In this oil cooler, a plurality of shells each having an oil flow path formed therein are laminated and a core portion is formed. A first and second oil passage holes are formed at first and second side ends of the core portion. So laminated shells are made to communicate with each other by the first and second oil passage holes. Further, a third oil passage hole is formed between the first oil passage hold and the second oil passage hole in a width direction of the core portion. Hereupon, only a part of all laminated shells in a lamination direction of the shells are made to communicate with each other by the third oil passage hole. And a blocking member is disposed in the oil flow path of the shell having the third oil passage hole so as to block oil flow, and the blocking member is disposed between the third oil passage hole and the first oil passage hole.

The shell can be constituted by a first plate member, a second plate member, and an inner fin, the oil flow path is formed between the first and second plate members, and the inner fin is received in the oil flow path. The third oil passage hole is formed only in the first plate member located on an outer side of an inner most shell disposed at an innermost of the third oil passage hole.

In a preferred embodiment, a reinforcing member is disposed in a position of extension of the third oil passage hole as well as between the innermost shell and one shell adjacent to the innermost shell having no third oil passage hole.

The reinforcing member can be fixed to the second plate member located on an inner side of the innermost shell.

In additional preferred embodiment, a through-hole is formed in the second plate member of the innermost shell in the position of extension of the third oil passage hole, and an annular reinforcing member is disposed in a position on an outside of the through-hole.

The annular reinforcing member can be bottomed.

Features and advantages of the invention will be evident form the following detailed description of the preferred embodiments described in conjunction with attached drawings.

DETAILED DESCRIPTION OF THE PREFERRED EMBODIMENTS

Embodiments of the present invention will be described below with reference to the drawings.

Figure 1:
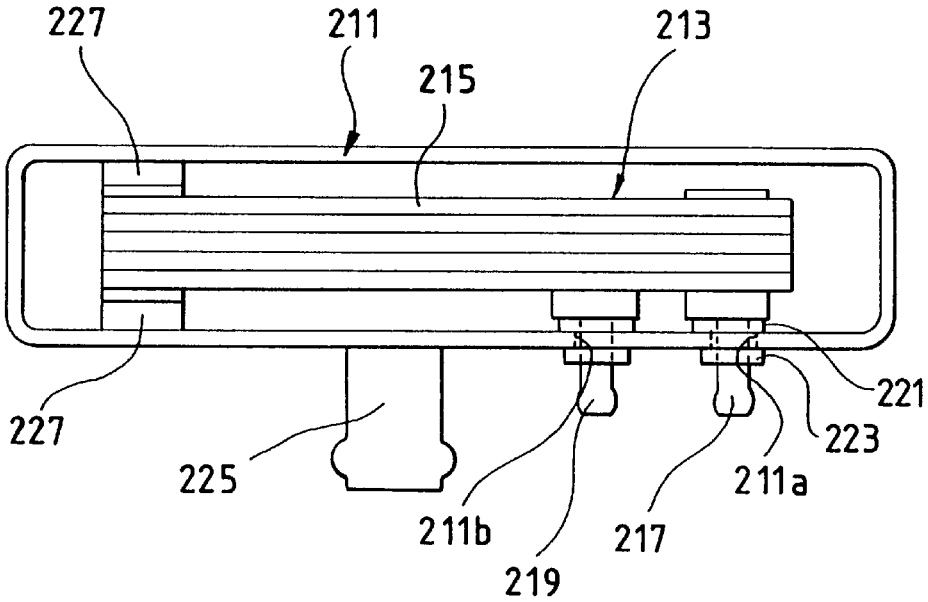
FIG. 1 is a top view showing a first embodiment of the structure for mounting an oil cooler to a heat exchanger tank according to the present invention.

FIG. 1 shows a first embodiment of a structure for mounting an oil cooler to a heat exchanger tank according to the present invention. In this embodiment, a long-scale oil cooler 213 is received in an radiator tank 21 made of resin.

This oil cooler 213 is constituted by a plurality of plate members 215 of aluminum which are laminated and brazed with one another.

An oil inlet pipe 217 and an oil outlet pipe 219 are disposed on one side of the oil cooler 213. These pipes 217 and 219 are inserted respectively in pipe holes 211*a* and 211*b* formed in the tank 211.

Further, these pipes 217 and 219 are fixed to the tank 11 through O-rings 221 by nuts 223.

A pipe portion 225 for the outflow of cooling water is opened in the tank 211.

On the other hand, a support portion 227 for supporting the other side of the oil cooler 213 is formed on an inner surface of the tank 211 in a position where the other side of the oil cooler 213 having no pipes 217 and 219 formed is located.

Figure 2:
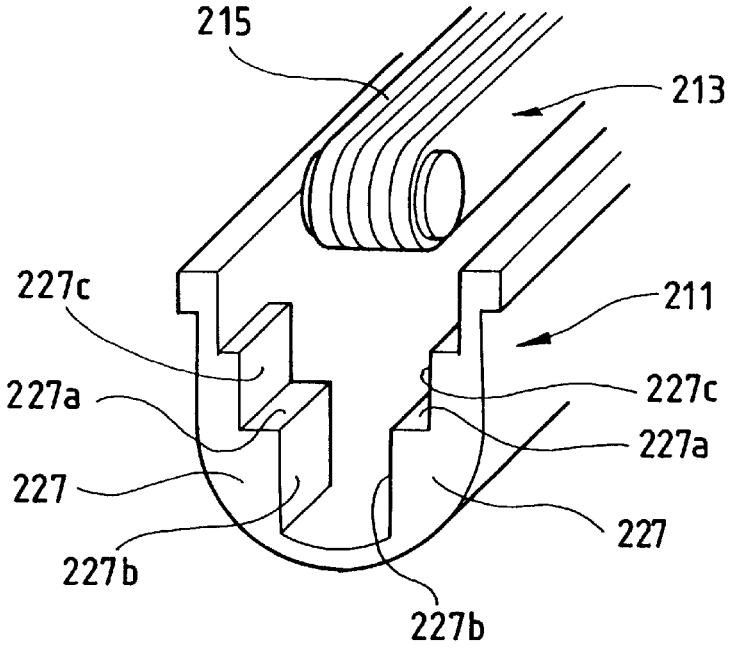
FIG. 2 is a perspective view showing the details of a support portion in the oil cooler depicted in FIG. 1.

As shown in FIG. 2, this support portion 227 is formed integrally with the tank 211.

In this embodiment, the support portion 227 is provided as a pair of parts opposite to each other in the direction of the width of the tank 211.

Step portions 227*a* are formed in the centers of the pair of parts respectively in the support portion 227.

First face portions 227*b* under the step portions 227*a* are formed so as to be disposed in opposite to each other widthwise at a certain distance so that a cooling water passage is formed by a gap between the face portions 227*b*.

Further, the lower surface of the oil cooler 213 is put on the step portions 227*a*.

The widthwise distance between second face portions 227*c* on the upper sides of the step portions 227*a* is selected to be substantially equal to the height in the direction of lamination of the oil cooler 213 on the other side. In this embodiment, two patch ends 243 are provided both side surfaces of the other side of the oil cooler 213, so the height in the direction of lamination of the oil cooler 213 includes the thickness of the patch ends 243. The other side of the oil cooler 213 is sandwiched between the pair of second face portions 227*c*.

In the configured structure for mounting an oil cooler to a heat exchanger tank, the support portion 227 provided as a pair of parts for supporting the other side of the oil cooler 213 having no pipes 217 and 219 formed is formed on the inner surface of the tank 211. Accordingly, the oil cooler 213 can be supported to the tank 211 securely even in the case where the pipes 217 and 219 are disposed only on one side of the oil cooler 213.

Figure 3:
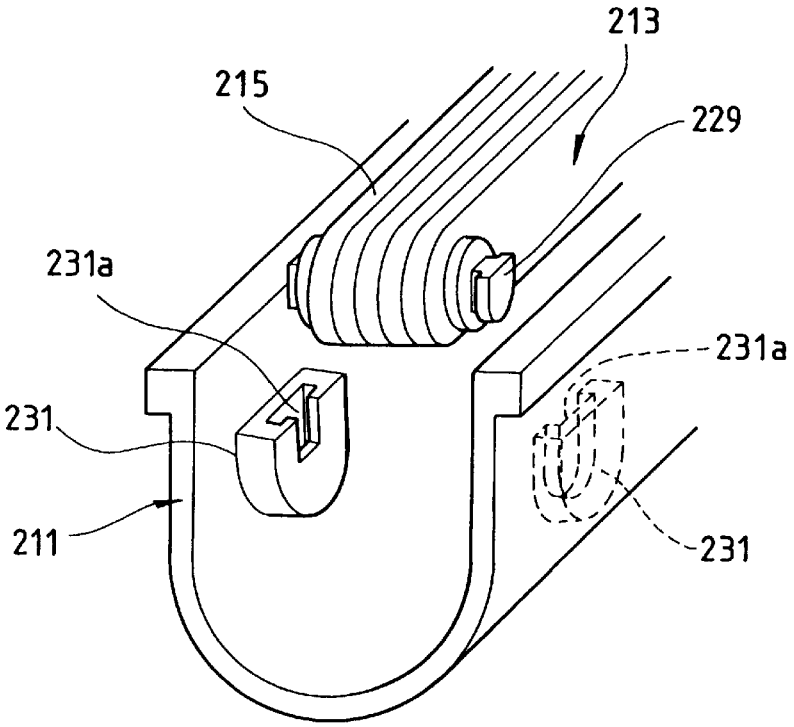
FIG. 3 is a perspective view showing a second embodiment of the structure for mounting an oil cooler to a heat exchanger tank according to the present invention.

FIG. 3 shows a second embodiment of the structure for mounting an oil cooler to a heat exchanger tank according to the present invention. In this embodiment, a protrusion portion 229 is formed on a bottom end in a lamination direction of the oil cooler 213.

This protrusion portion 229 is shaped like an oval halved in the width-wise direction.

On the other hand, a support portion 231 having a cavity portion 231*a* formed so as to correspond to the protrusion portion 229 is formed integrally with the inner surface of the tank 211.

Further, the protrusion portion 229 of the oil cooler 213 is inserted in the cavity portion 231*a* formed in the support portion 231, so that the other side of the oil cooler 213 is supported to the tank 211.

Figure 4:
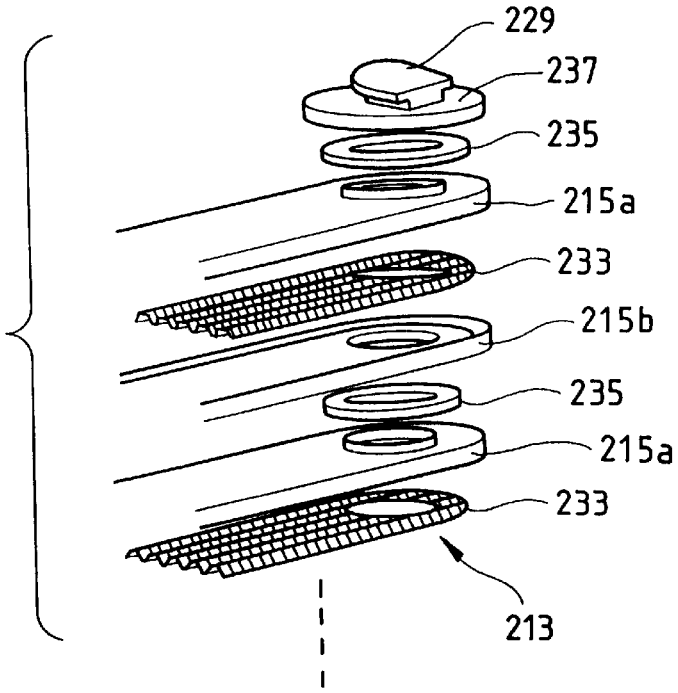
FIG. 4 is a perspective view showing the lamination structure of the oil cooler depicted in FIG. 3.

Incidentally, in this embodiment, the oil cooler 213 is formed in the following manner, as shown in FIG. 4. That is, combinations each having an inner fin 233 received between a first plate member 215*a* and a second plate member 215*b* are laminated with one another through spacers 235 and brazed with one another in the condition that a patch end 237 is disposed at an end portion of the laminate.

Further, this embodiment employs an oil cooler in which the protrusion portion 229 is formed integrally with the patch end 237.

In the structure for mounting an oil cooler to a heat exchanger tank in this embodiment, the protrusion portion 229 is formed on the other side of the oil cooler so as to be fitted to the support portion 231. Accordingly, the oil cooler 213 can be supported to the tank 211 more securely.

Further, because the protrusion portion 229 is formed integrally with the patch end 237, the protrusion portion 229 can be formed easily.

In this embodiment, two support portion 231 are provided on both sides of the oil cooler 213, however, it is possible to eliminate one of the two support portion 231 and only one support portion can be provided.

Figure 5:
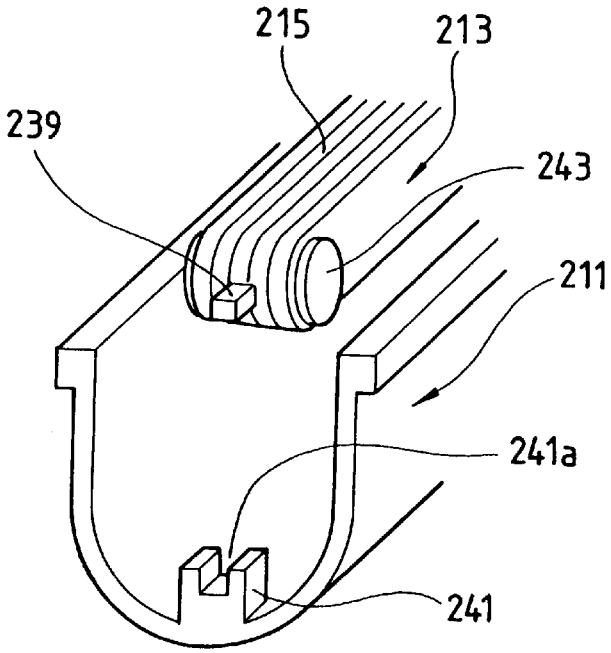
FIG. 5 is a perspective view showing a third embodiment of the structure for mounting an oil cooler to a heat exchanger tank according to the present invention.

FIG. 5 shows a third embodiment of the structure for mounting an oil cooler to a heat exchanger tank according to the present invention. In this embodiment, a rectangular protrusion portion 239 is formed at one side end of the oil cooler 213.

On the other hand, a support portion 241 having a cavity portion 241*a* formed so as to correspond to the protrusion portion 239 is formed integrally with the inner surface of the tank 211.

Further, the protrusion portion 239 of the oil cooler 213 is inserted in the cavity portion 241*a* formed in the support portion 241, so that the other side of the oil cooler 213 is supported to the tank 211.

Figure 6:
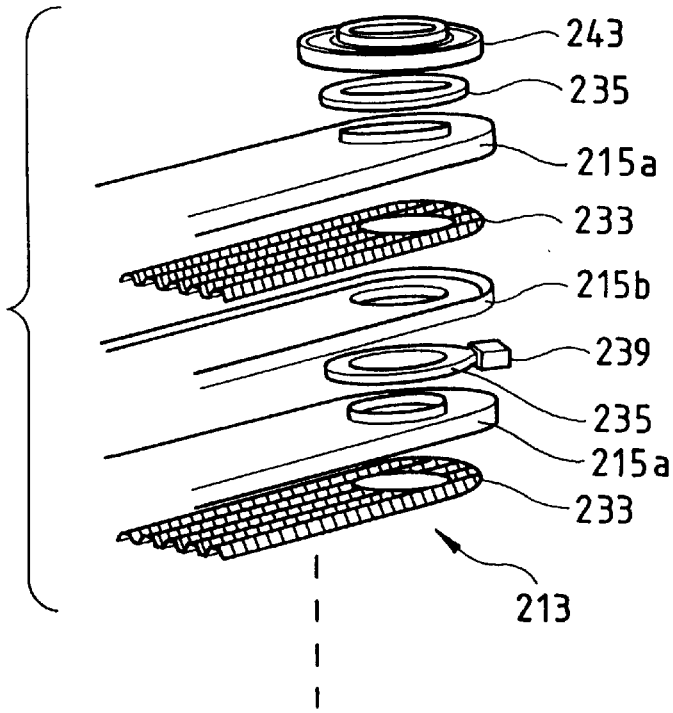
FIG. 6 is a perspective view showing the lamination structure of the oil cooler depicted in FIG. 5.

Incidentally, in this embodiment, the oil cooler 213 is formed in the following manner, as shown in FIG. 6. That is, combinations each having an inner fin 233 received between a first plate member 215*a* and a second plate ember 215*b* are laminated with one another through spacers 235 and brazed with one another in the condition that a patch end 243 is disposed at an end portion of the laminate.

Further, in this embodiment, the protrusion portion 239 is formed integrally with a spacer 235 located in the center of the laminate.

In the structure for mounting an oil cooler to a heat exchanger tank in this embodiment, the protrusion portion 239 is formed on the other side of the oil cooler 213 so as to be fitted to the support portion 241. Accordingly, the oil cooler 213 can be supported to the tank 211 more securely.

Further, because the protrusion portion 239 is formed integrally with the spacer 235, the protrusion portion 239 can be formed easily.

Figure 7:
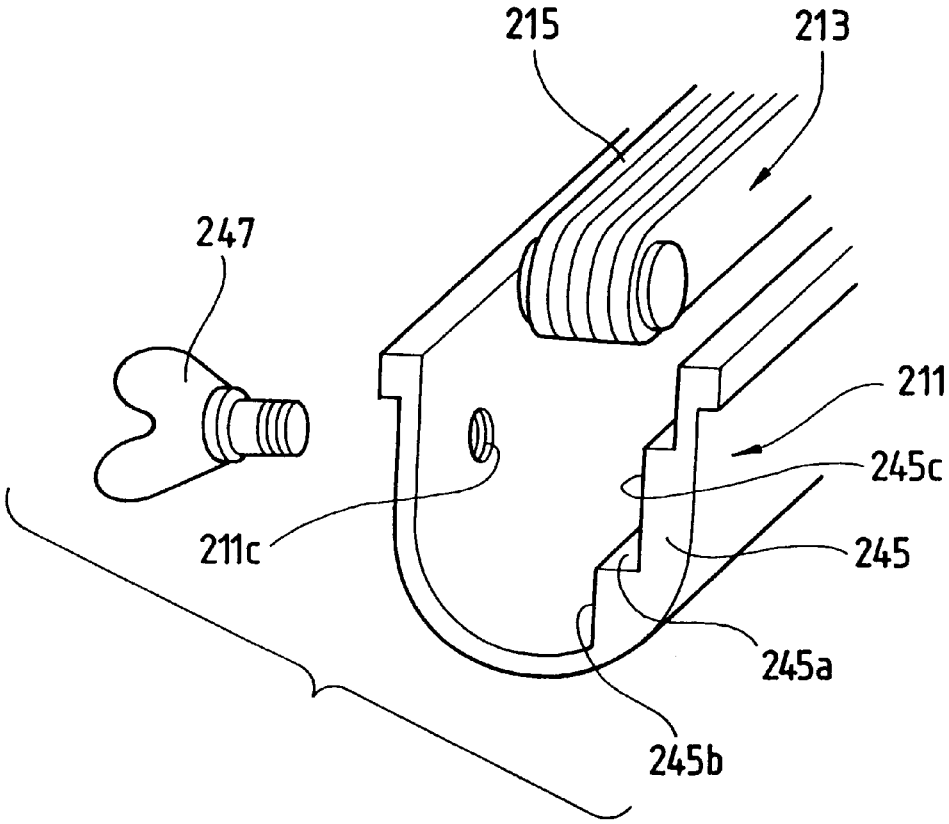
FIG. 7 is a perspective view showing a fourth embodiment of the structure for mounting an oil cooler to a heat exchanger tank according to the present invention.
Figure 8:
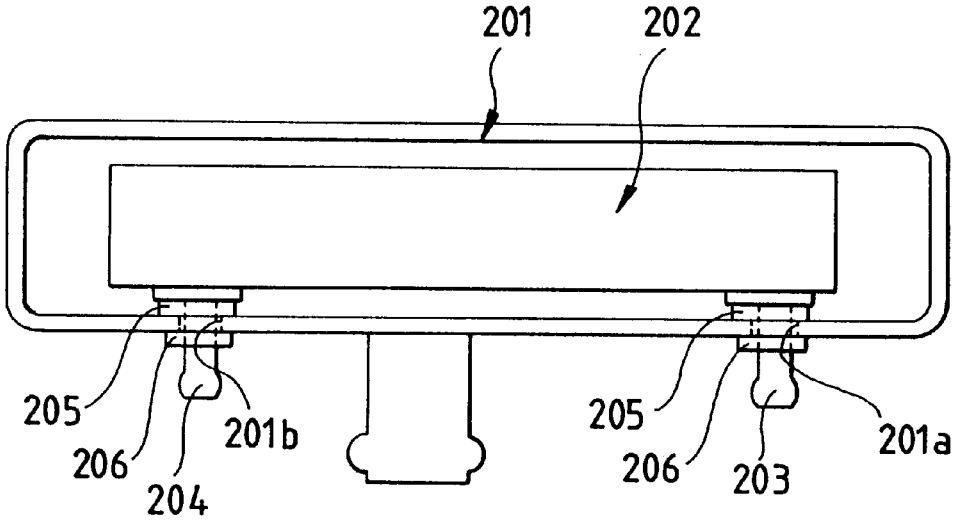
FIG. 8 is a top view showing an example of a structure for mounting an oil cooler to a heat exchanger tank.
Figure 9:
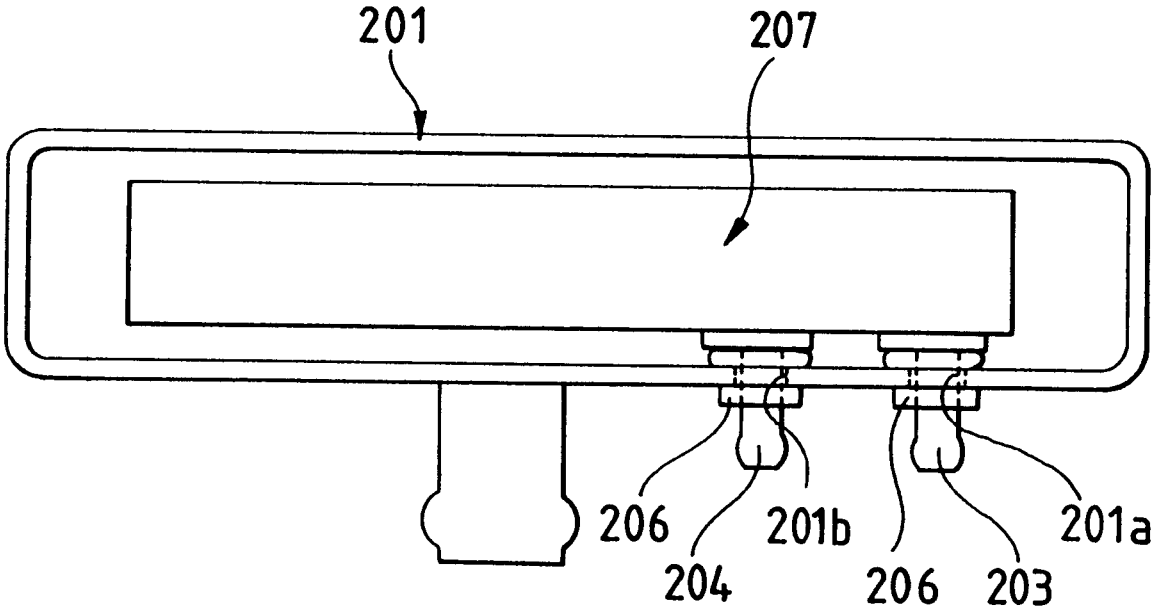
FIG. 9 is a top view showing a structure for mounting an oil cooler to a tank in the case where pipe portions are formed only on one side of the oil cooler.

FIG. 7 shows a fourth embodiment of the structure for mounting an oil cooler to a heat exchanger tank according to the present invention. In this embodiment, a drain hole 211*c* is formed in the tank 211 and a support portion 245 is formed in a position opposite to the drain hole 211*c* integrally with the inner surface of the tank 211.

This support portion 245 is constituted by a step portion 245*a*, a first face portion 245*b* formed under the step portion 245*a*, and a second face portion 245*c* formed above the step portion 245*a* in the same manner as in the first embodiment.

Further, a drain valve 247 is thread-engaged with the drain hole 211*c* in the condition that the lower surface of the oil cooler 213 is disposed on the step portion 245*a*. As a result, the oil cooler 213 is pressed against the second face portion 245*c* to thereby fix the other side of the oil cooler 213 to the tank 211.

In the structure for mounting an oil cooler to a heat exchanger tank in this embodiment, the oil cooler 213 is pressed against the support portion 245 by the drain valve 247. Accordingly, the oil cooler can be fixed to the tank 211 more securely.

Further, generally, the drain valve 247 is used for the exchange of the cooling water. In this embodiment, the drain valve 247 disposed in the tank 211 is used also as a pressing member, so the increase in number of parts can be eliminated.

Although the aforementioned structure for mounting an oil cooler to a heat exchanger tank has been described about the case where the present invention is applied to a laminate type oil cooler 213, the present invention is not limited to such embodiments but may be applied to, for example, a round pipe type oil cooler.

Figure 10:
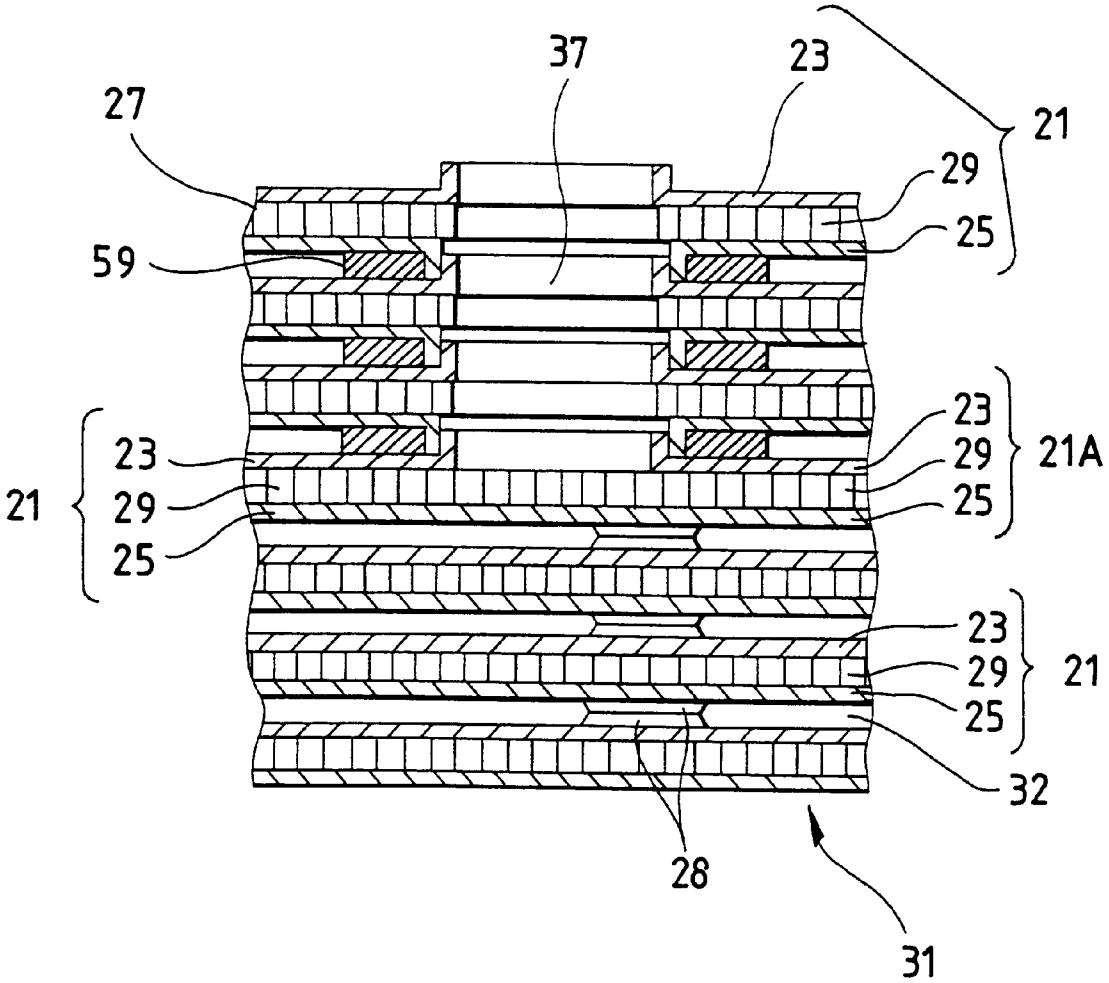
FIG. 10 is a sectional view showing the details of a main part in a laminate type oil cooler of FIG. 11.
Figure 11:
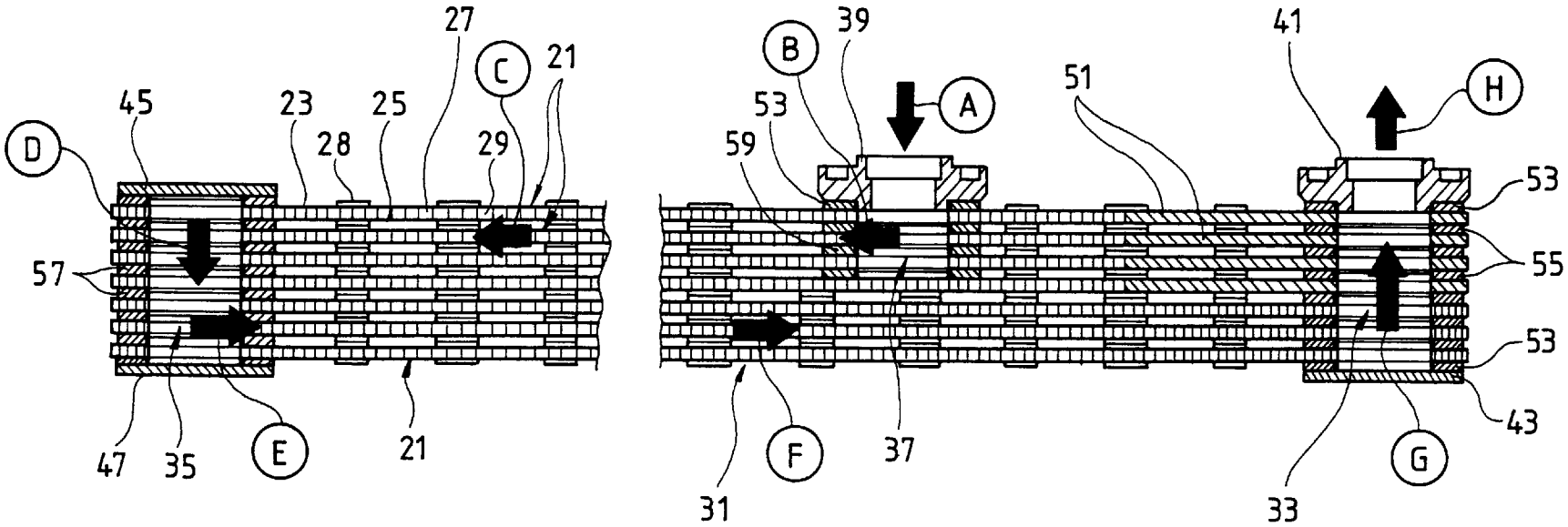
FIG. 11 is a sectional view showing the laminate type oil cooler according to a fifth embodiment of the present invention.
Figure 12:
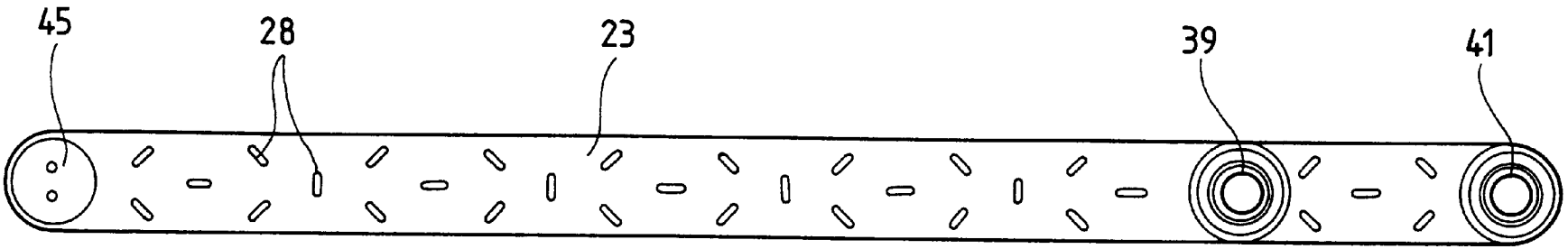
FIG. 12 is a top view showing the laminate type oil cooler of FIG. 11.

FIG. 10 shows the details of main parts of FIGS. 11 and 12, respectively. FIGS. 11 and 12 show a fifth embodiment of a laminate type oil cooler according to the present invention.

In FIGS. 11 and 12, the reference numeral 21 designates shells each having an oil flow path 27 formed between a first plate member 23 and a second plate member 25.

Beads 28 are formed so as to be protruded outward from both the first plate member 23 and the second plate member 25, respectively.

The oil flow paths 27 of the shells 21 receive inner fins 29 respectively.

The shells 21 are laminated to form a core portion 31.

Cooling fluid gaps 32 are formed between the shells 21 of the core portion 31 by the beads 28.

A first oil passage hole 33 is formed at one end of these shells 21 and a second oil passage hole 35 is formed at the other end of these shells 21.

In this embodiment, a third oil passage hole 37 is formed in the core portion 31 between the first oil passage hole 33 and the second oil passage hole 35 in width direction of the core portion 31 so as to make four layers of the shells 21 located on one side of the core portion 31 communicate with one another.

Further, a first connector 39, which serves as an oil inflow connector, is disposed so as to cover the third oil passage hole 37.

Further, a second connector 41, which serves as an oil outflow connector, is disposed so as to cover the first oil passage hole 33.

A side of the first oil passage hole 33 opposite to the second connector 41 is covered with a patch member 43.

Opposite sides of the second oil passage hole 35 are covered with patch members 45 and 47 respectively.

Further, blocking members 51 for blocking the oil flow paths 27 are disposed between the third oil passage hole 37 and the first oil passage hole 33 in the shells 21 in which the third oil passage hole 37 is formed.

Figure 13:
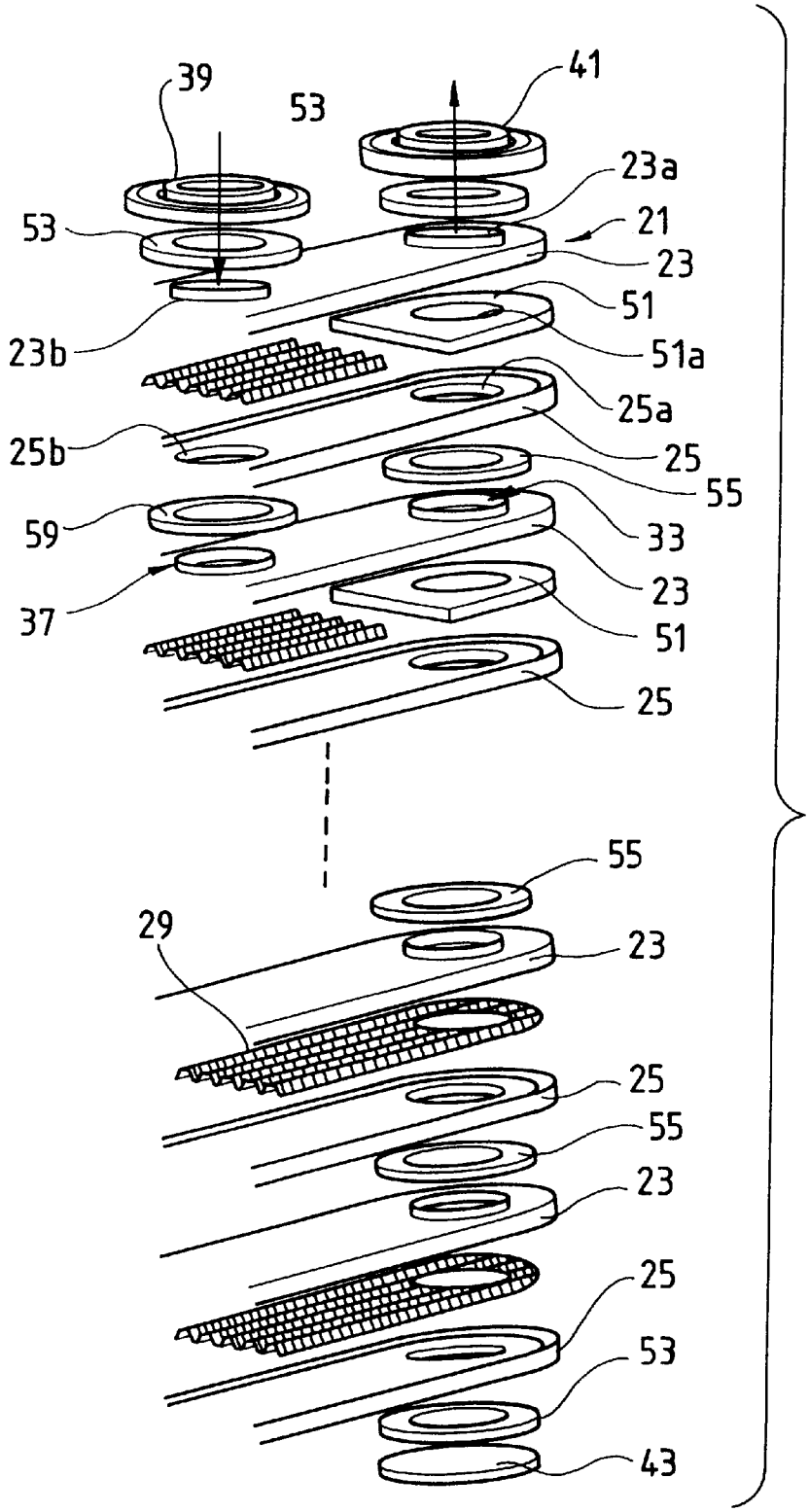
FIG. 13 is an exploded perspective view showing the third and first oil passage holes and their vicinity in the laminate type oil cooler of FIGS. 10 to 12.

FIG. 13 shows the details of the aforementioned first and third oil passage holes 33 and 37. In FIG. 13, burring portions 23*a* and 23*b* are formed so as to be protruded toward the second and first connectors 41 and 39 from the first and third oil passage holes 33 and 37 respectively in each of the first plate members 23 constituting the shells 21.

Further, burring portions 25*a* and 25*b* are formed so as to be protruded toward the patch member 43 from the first and third oil passage holes 33 and 37 respectively in each of the second plate members 25.

Annular sheet members 53 are disposed on the outside of the burring portions 23*a* and 23*b* of the first plate member 23 located in the uppermost portion. The connectors 39 and 41 are brazed with the first plate member 23 through the sheet members 53 respectively.

Further, as shown in FIG. 11, spacers 55, 57 and 59 are disposed in portions where the first, second and third oil passage holes 33, 35 and 37 are formed in the core portion 31.

Further, in this embodiment, blocking members 51 for blocking the oil flow paths 27 are disposed between the third and first oil passage holes 37 and 33 in shells 21 in which the third oil passage hole 37 is formed.

Each of the blocking members 51, which is shaped like a substantial oval halved in the width-wise direction, is sandwiched between the first and second plate members 23 and 25 and brazed therewith.

A though-hole 51*a* is formed in a position of each of the blocking members 51 corresponding to the first oil passage hole 33.

FIG. 10 shows the details of the aforementioned third oil passage hole 37. In FIG. 10, the third oil passage hole 37 is formed so as to pierce three shells 21 from one surface side of the core portion 31.

Further, with respect to the innermost, that is, the fourth layer shell 21A, the third oil passage hole 37 is formed only in the first plate member 23 located on the outer side of the shell 21A.

Further, annular spacers 59 are disposed on the outside of the third oil passage hole 37 and between the shells 21 in which the third oil passage hole 37 is formed.

Incidentally, in this embodiment, the first and second plate members 23 and 25, the connectors 39 and 41, the patch members 43, 45 and 47, the sheet members 53, the blocking members 51, the spacers 55, 57 and 59 and the inner fins 29 are made of aluminum and brazed with one another.

Further, each of the first and second plate members 23 and 25 is made from an aluminum clad material having a brazing material layer formed on its one surface, and each of the sheet members 53, the spacers 55, 57 and 59 and the blocking members 51 is made from an aluminum clad material having brazing material layers formed on its opposite surfaces.

The aforementioned laminate type oil cooler is produced by the steps of: receiving the inner fins 29 between the first and second plate members 23 and 25 constituting the shells 21; receiving the blocking members 51 only in shells 21 having the third oil passage hole 37 formed therein; disposing the spacers 55, 57 and 59 in necessary positions between the shells 21; attaching the sheet members 53 to the burring portions 25*a* of the second plate members 25 respectively on the patch member 43 side; laminating the shells 21 to form the core portion 31; assembling the connectors 39 and 41 and the patch members 43, 45 and 47 with the core portion 31; and brazing the respective members with one another in a heating furnace in the condition that opposite sides of the core portion 31 are pressed against each other by a jig not shown.

Further, in the aforementioned laminate type oil cooler, the blocking members 51 for blocking the oil flow paths 27 are disposed in the positions between the third and first oil passage holes 37 and 33 in the shells 21 having the third oil passage hole 37 formed therein. Accordingly, for example, oil poured from the first connector 39 into the core portion 31 passes through the oil flow paths 27 formed in the shells 21 so as to be led form the third oil passage hole 37 formed in a plurality of shells 21 located on a side of the core portion 31 to the second oil passage hole 35 formed at an end of the c ore portion 31 opposite to the first oil passage hole 33 (arrows A, B and C and D in FIG. 11). The oil further passes through the oil flow paths 27 in shells 21 having no third oil passage hole 37 so as to be led from the second oil passage hole 35 to the first oil passage hole 33 (arrows E and F). In this manner, the oil flows out from the second connector 41 to the outside (arrows G and H).

In the laminate type oil cooler configured as described above, first and second oil passage holes 33 and 35 are formed at one side end and the other side end, respectively, of the core portion 31 so that adjacent ones of the shells 21 are communicated with each other; a third oil passage hole 37 is formed in the inside of the core portion 31 at the one side end thereof so that a plurality of shells 21 located on one side of the core portion 31 are communicated with one another; a first connector 39 communicated with the third oil passage hole 37 and a second connector 41 communicated with the first oil passage hole 33 are disposed on the core portion 31, and blocking members 51 for blocking the oil flow paths 27 are disposed in the shells 21 having the third oil passage hole 37 formed therein and between the third oil passage hole 37 and the first oil passage hole 33. Accordingly, the connector 39 for oil inflow and the connector 41 for oil outflow can be disposed on one side of the core portion 31 easily so as to be close to each other.

Further, in the aforementioned laminate type oil cooler, because the first and second plate members 23 and 25, the patch members 43, 45 and 47, the first connector 39, the second connector 41, the blocking members 51, the spacers 55, 57 and 59 and the inner fins 29 are made of aluminum and joint portions thereof are brazed with one another, these members can be bonded to one another easily and securely.

Figure 14:
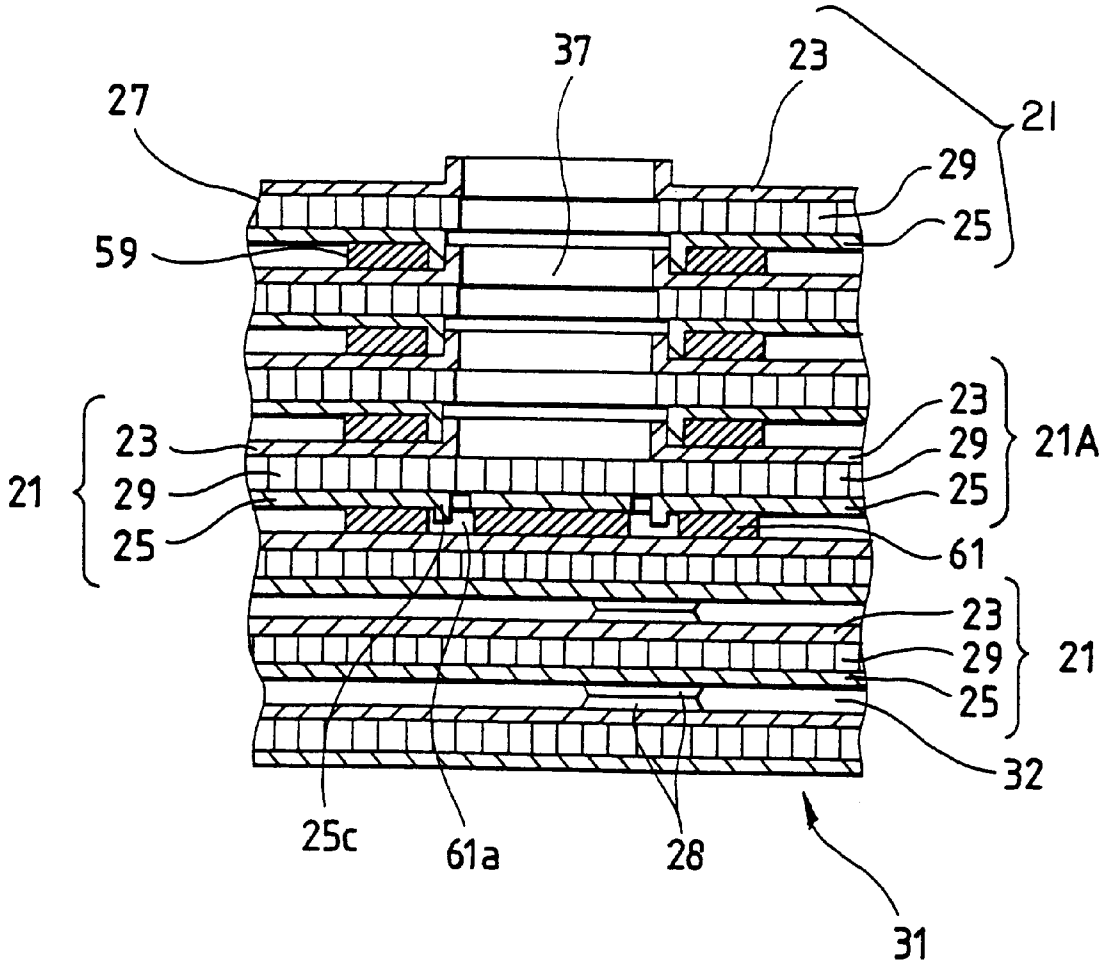
FIG. 14 is a sectional view showing the details of a main part in a laminate type oil cooler of FIG. 16.
Figure 15:
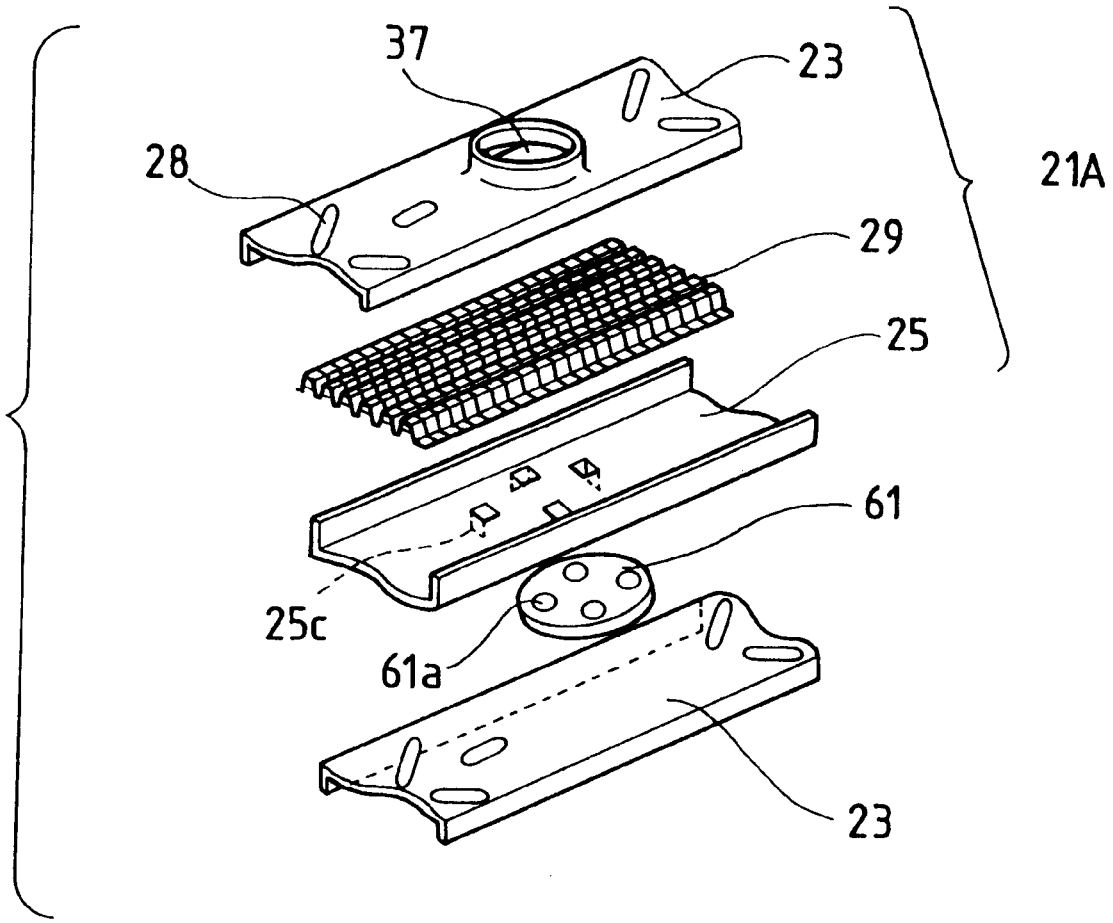
FIG. 15 is an exploded perspective view showing the details of a main part of FIG. 16.
Figure 16:
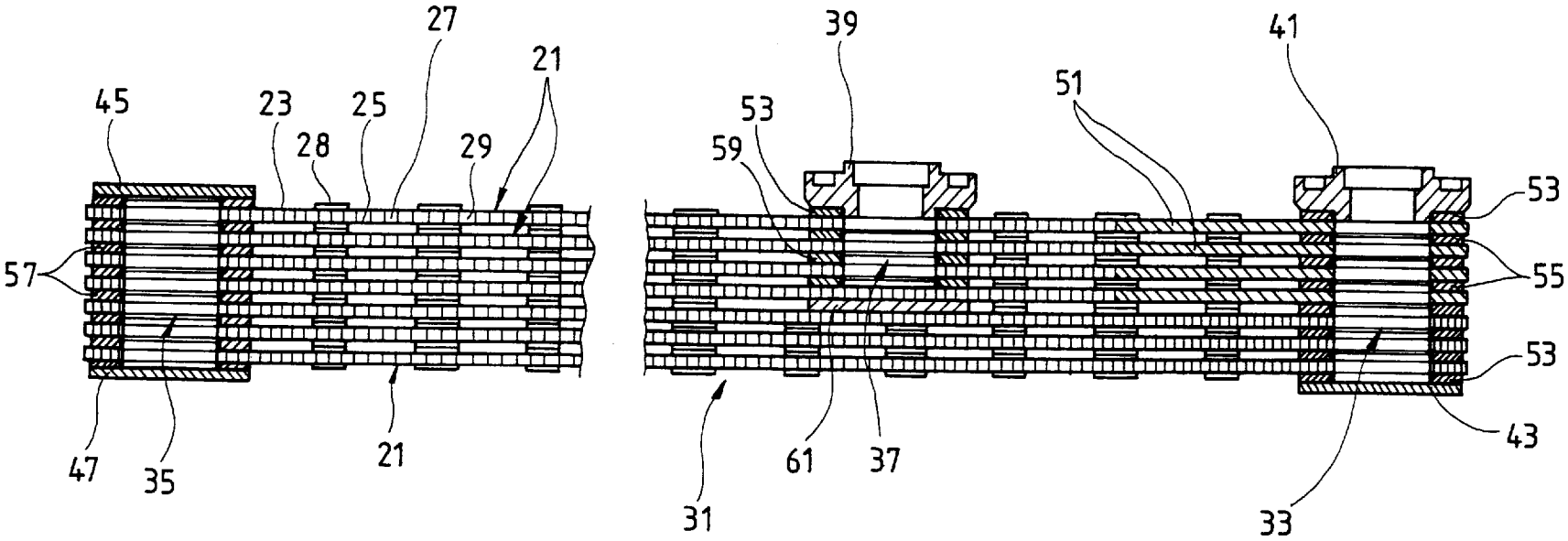
FIG. 16 is a sectional view showing the laminate type oil cooler according to a sixth embodiment of the present invention.

FIGS. 14 and 15 show the details of main parts of FIG. 16, respectively. FIGS. 14 to 16 show a sixth embodiment of a laminate type oil cooler according to the present invention.

In this embodiment, a reinforcing member 61 is disposed between the innermost shell 21A having the oil passage hole 37 formed only in the first plate member 23 and a shell 21 adjacent to the shell 21A and having no oil passage hole.

The reinforcing member 61 is disposed in a position of extension of the third oil passage hole 37.

The reinforcing member 61 is made of aluminum and brazed other parts. The reinforcing member 61 is disposed between the shells 21 like the spacers 55, 57 and 59 in the producing process.

In this embodiment, as shown in FIG. 15, the oil passage hole 37 is formed only in the first plate member 23, and four lock protrusions 25*c* are disposed in the form of a cross so as to be protruded toward the reinforcing member 61 from the second plate member 25 located on the inside of the innermost shell 21A.

On the other hand, engagement holes 61*a* are formed in the reinforcing member 61 so that the aforementioned lock protrusions 25*c* are inserted in the engagement holes 61*a* respectively.

In the laminate type oil cooler configured as described above, because the reinforcing member 61 is disposed in a position of extension of the third oil passage hole 37 between the innermost shell 21A having the third oil passage hole 37 formed only in the first plate member 23 and a shell 21 adjacent to the shell 21A and having no oil passage hole, the second plate member 25 of the innermost shell 21A is supported, through the reinforcing member 61, by the adjacent shell 21 having no oil passage hole. Accordingly, when the third oil passage hole 37 is formed so as to pierce the shells 21 partially from one surface side of the core portion 31, the innermost shell 21A can be prevented easily and securely from being deformed.

Further, in the aforementioned laminate type oil cooler, because the reinforcing member 61 is fixed to the second plate member 25 located on the inside of the innermost shell 21A having the third oil passage hole 37 formed only in the first plate member 23, the reinforcing member 61 can be located in a predetermined position securely.

Figure 17:
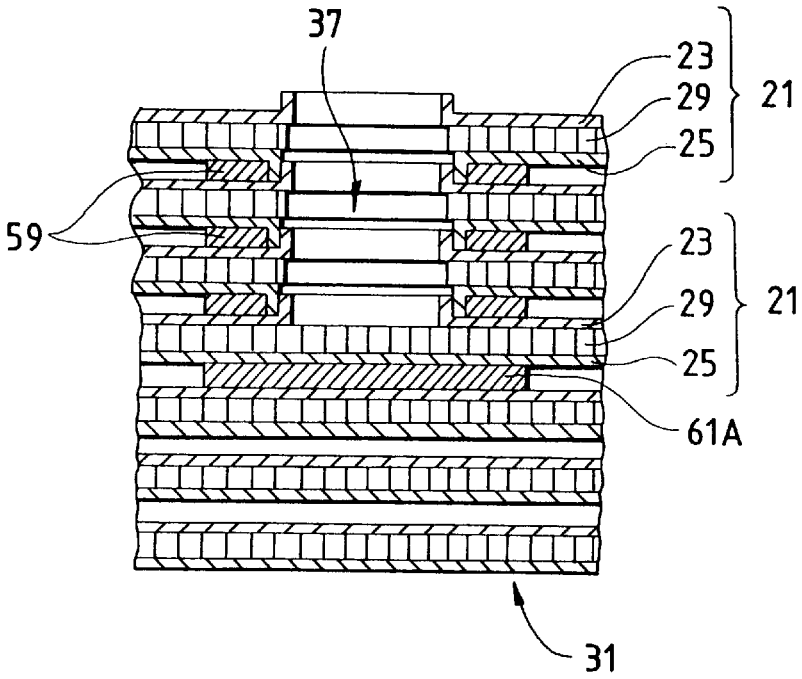
FIG. 17 is a sectional view showing the details of a main part of the laminate type oil cooler according to a seventh embodiment of the present invention.
Figure 18:
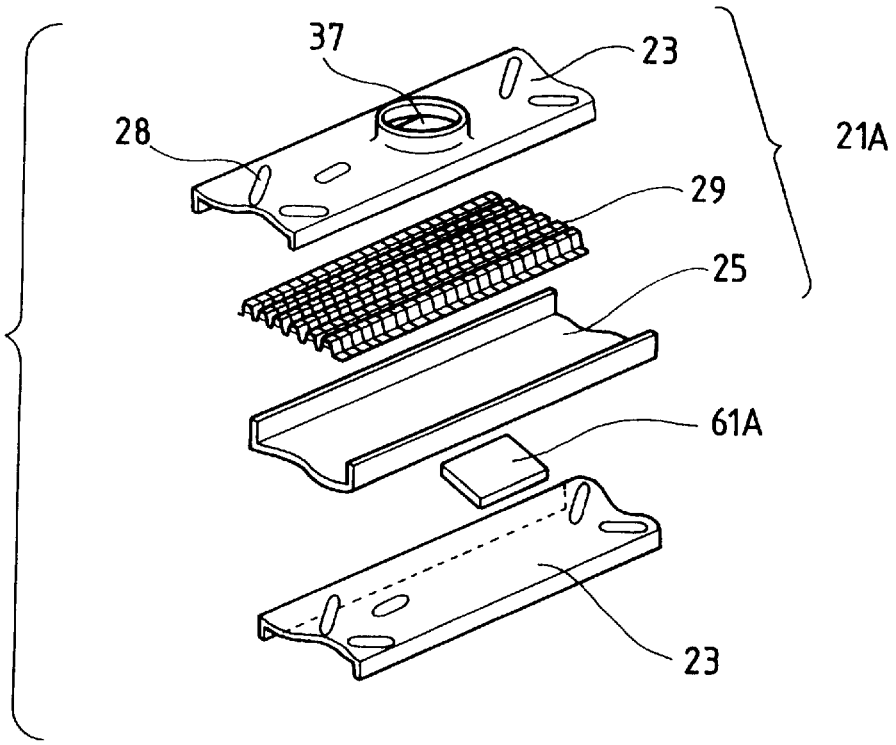
FIG. 18 is an exploded perspective view showing the details of a main part of FIG. 17.

FIGS. 17 and 18 show the details of main parts of the laminate type oil cooler according to a seventh embodiment of the present invention. This embodiment is different from the six embedment in that the lock protrusions 25*c* are not formed on the second plate member 25 located on the inside of the innermost shell 21A and the engagement holes 61*a* are not formed in the reinforcing member 61A.

Further, in this embodiment, the reinforcing member 61A is made from a rectangular plate material having brazing material layers formed on its opposite surfaces.

The reinforcing member 61A is formed so that the size of the reinforcing member 61A is sufficiently larger than the size of the third oil passage hole 37.

Incidentally, in this embodiment, the same parts as those in the sixth embodiment are referenced correspondingly, and the detailed description thereof will be omitted.

Also in the seventh embodiment, substantially the same effect as that in the sixth embodiment can be obtained.

Further, in the seventh embodiment, because the reinforcing member 61A is shaped like a rectangle, it becomes easy to position the reinforcing member 61A.

Figure 19:
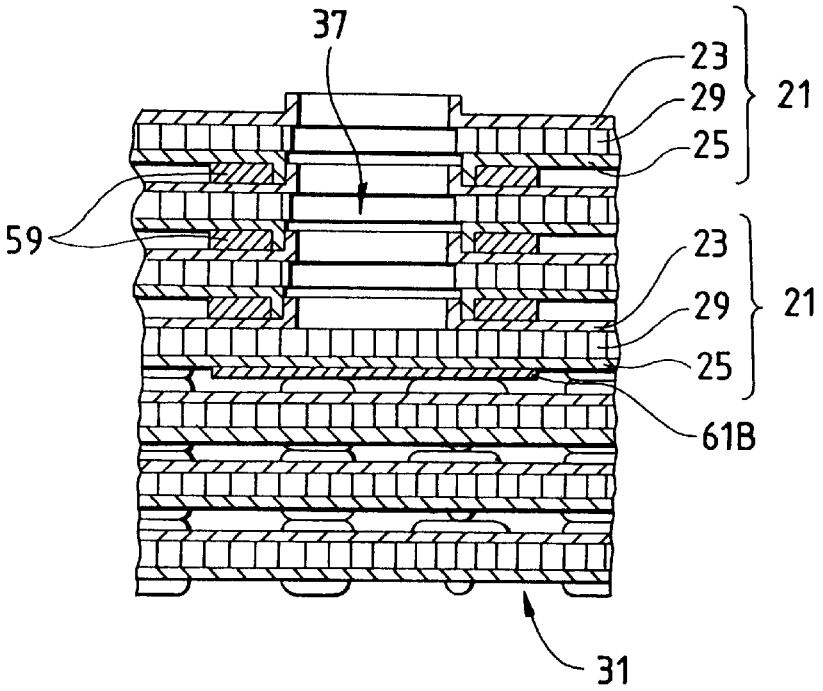
FIG. 19 is a sectional view showing the details of a main part of the laminate type oil cooler according to an eighth embodiment of the present invention.
Figure 20:
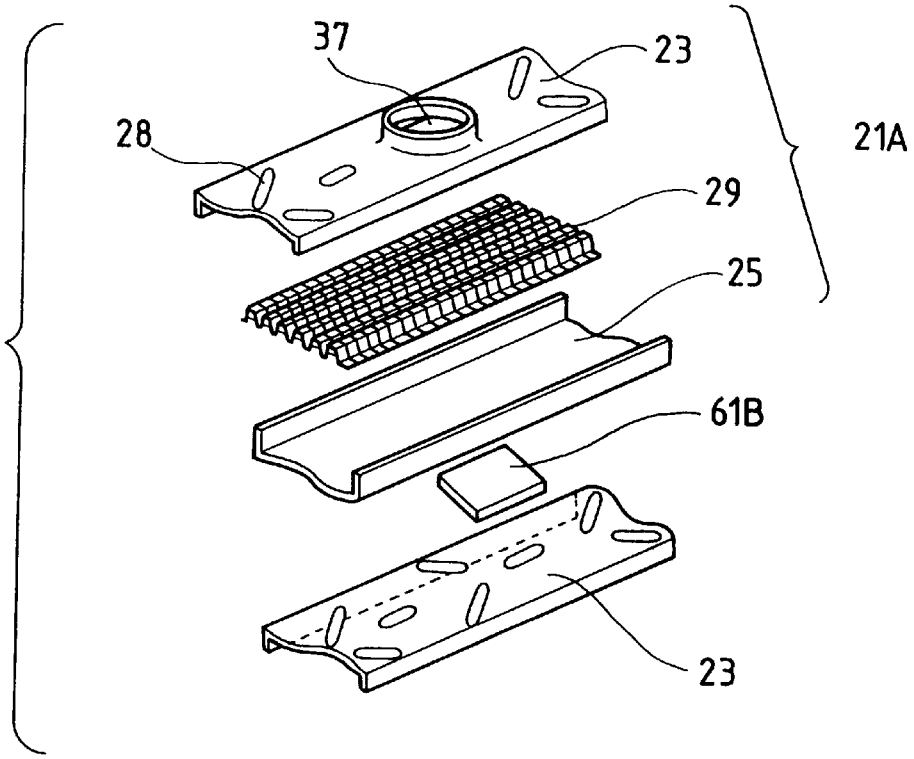
FIG. 20 is an exploded perspective view showing the details of a main part of FIG. 19.

FIGS. 19 and 20 show the details of main parts of the laminate type oil cooler according to an eighth embodiment of the present invention. In this embodiment, the reinforcing member 61B is disposed between the second plate member 25 located on the inside of the innermost shell 21A and beads 28 which are formed so as to be protruded from the first plate member 23 in a shell 21 adjacent to the shell 21A.

This reinforcing member 61B is made from a rectangular plate material having brazing material layers formed on its opposite surfaces.

This reinforcing member 61B is formed so that the plate thickness of the reinforcing member 61B is smaller than the plate thickness of the reinforcing member 61A in the above embodiments by the height of the beads 28.

Incidentally, in this embodiment, the same parts as those in the above embodiments are referenced correspondingly, and the detailed description thereof will be omitted.

Also in the eighth embodiment, substantially the same effect as that in the above embodiments can be obtained.

Further, in the eighth embodiment, because the plate thickness of the reinforcing member 61B can be reduced, reduction in weight can be attained.

Figure 21:
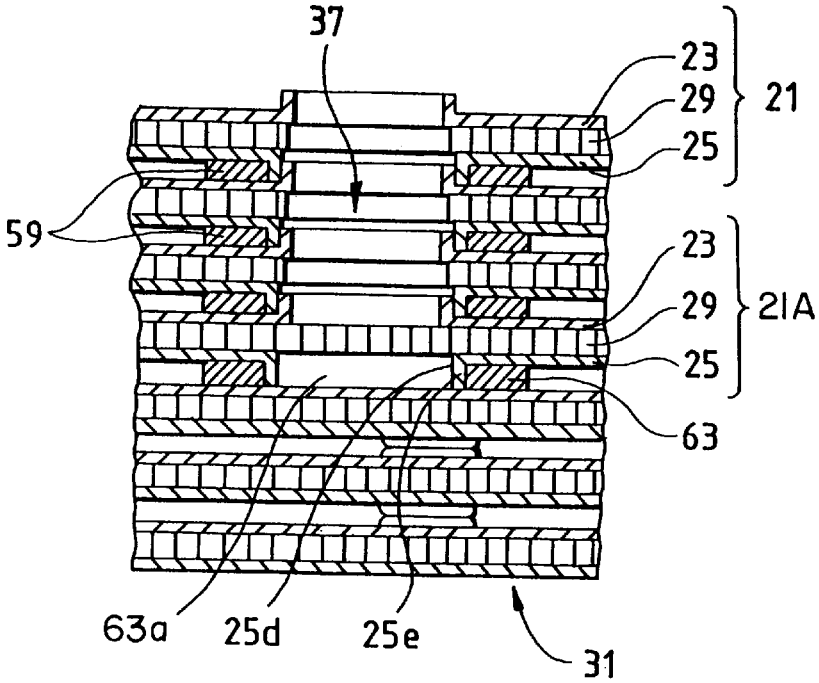
FIG. 21 is a sectional view showing the details of a main part of the laminate type oil cooler according to a ninth embodiment of the present invention.
Figure 22:
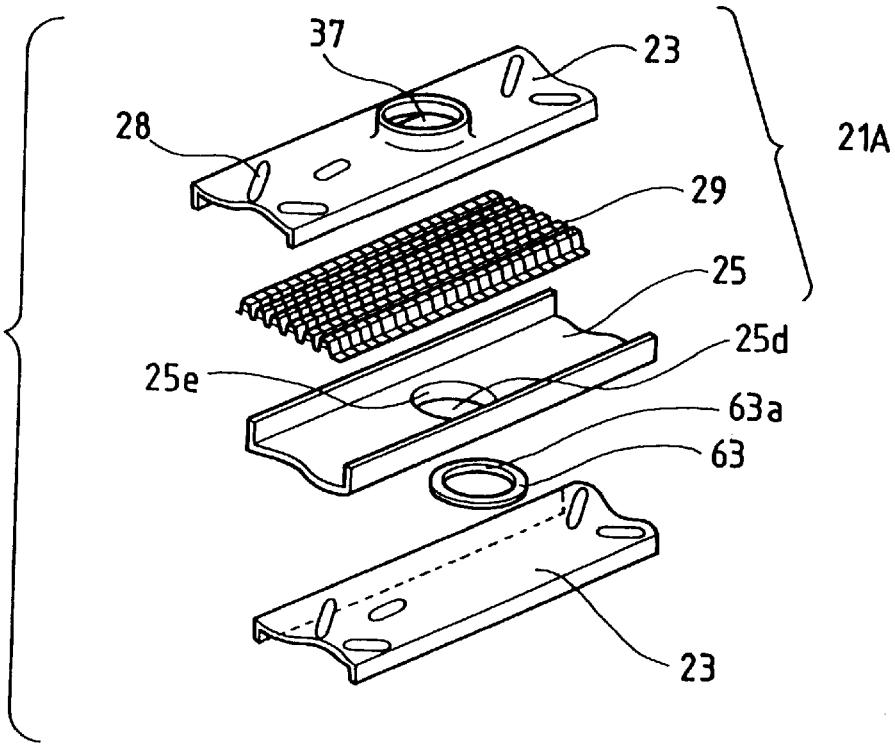
FIG. 22 is an exploded perspective view showing the details of a main part of FIG. 21.

FIGS. 21 and 22 show the details of main parts of the laminate type oil cooler according to a ninth embodiment of the present invention. In this embodiment, the third oil passage hole 37 is formed so as to pierce three shells 21 from one surface side of the core portion 31.

Further, in the innermost, that is, the fourth layer shell 21A, the third oil passage hole 37 is formed only in the first plate member 23 located on the outer side of the shell 21A.

Further, in the innermost, that is, the fourth layer shell 21A, a through-hole 25*d* is formed in the second plate member 25 located on the inner side of the shell 21A.

This through-hole 25*d* is formed in a position of extension of the third oil passage hole 37 so that the diameter of the through-hole 25*d* is equal to the diameter of the hole of the second plate member.

Further, an annular reinforcing member 63 is disposed on the outside of the through-hole 25*d*.

In this embodiment, a burring portion 25*e* is formed in the through-hole 25*d* so as to be protruded toward the reinforcing member 63. This burring portion 25*e* is inserted in a hole portion 63*a* of the reinforcing member 63.

Incidentally in this embodiment, the same parts as those in the above embodiments are referenced correspondingly, and the detailed description thereof will be omitted.

Also in the ninth embodiment, substantially the same effect as that in the above embodiments can be obtained.

Further, in the ninth embodiment, because the through-hole 25*d* is formed in a position of extension of the third oil passage hole 37 in the second plate member 25 located on the inner side of the innermost shell 21A having the third oil passage hole 37 formed only in its first plate member 23, a shell adjacent to the shell 21A can be used as a reinforcing member.

Incidentally, in this case, the third oil passage hole 37 is not always required to be formed in the inner fin 29 received in the innermost shell 21A. However, when the third oil passage hole 37 is formed in the inner fin 29, oil-flow resistance can be reduced more greatly.

Further, in this embodiment, because the burring portion 25*e* is formed in the through-hole 25*d* formed in the second plate member 25 so that the burring portion 25*e* is inserted in the hole portion 63*a* of the reinforcing member 63, the reinforcing member 63 can be located in a predetermined position securely.

Figure 23:
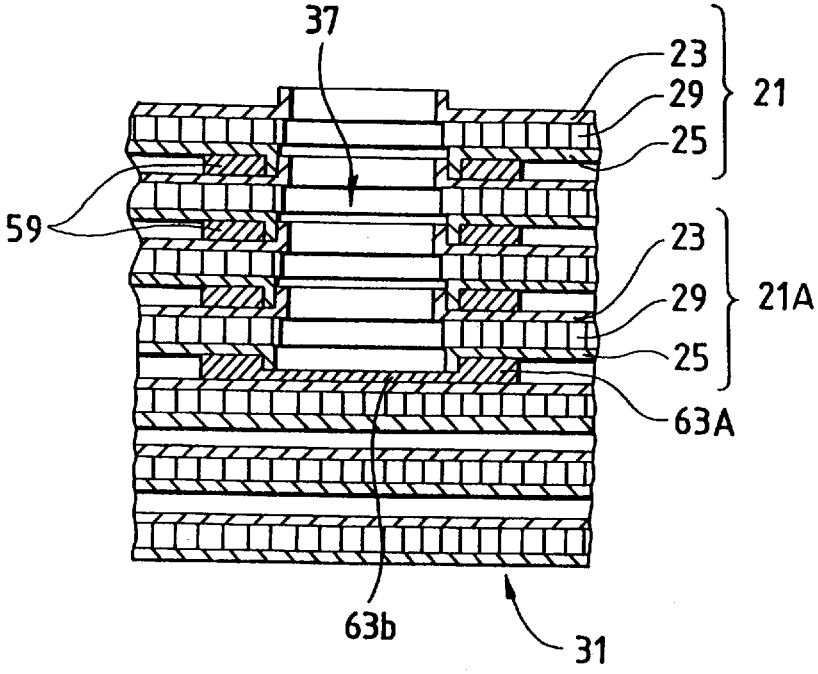
FIG. 23 is a sectional view showing the details of a main part of the laminate type oil cooler according to a tenth embodiment of the present invention.
Figure 24:
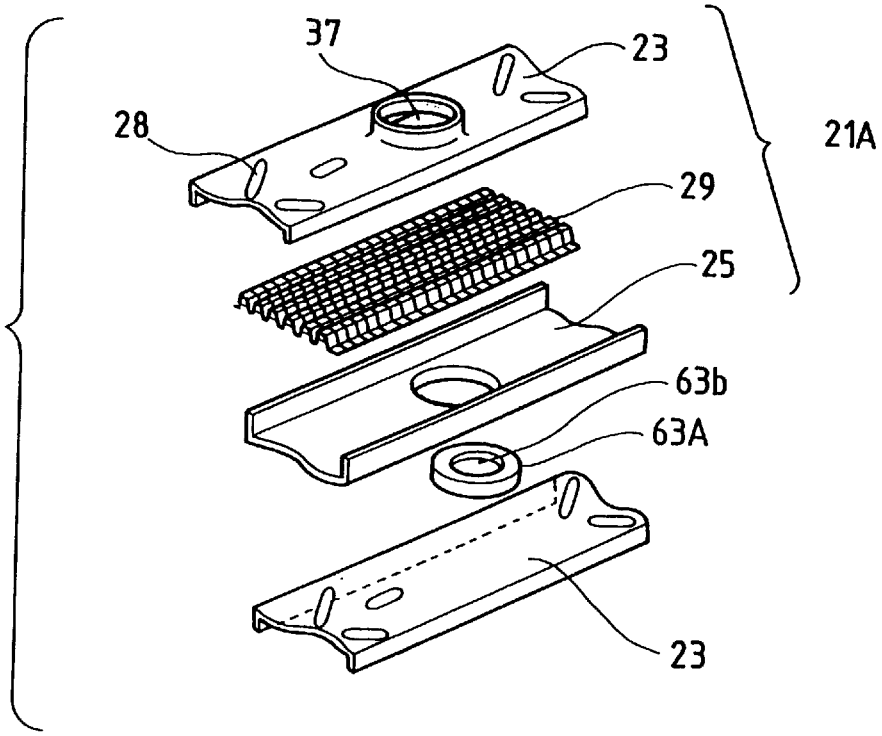
FIG. 24 is an exploded perspective view showing the details of a main part of FIG. 23.
Figure 25:
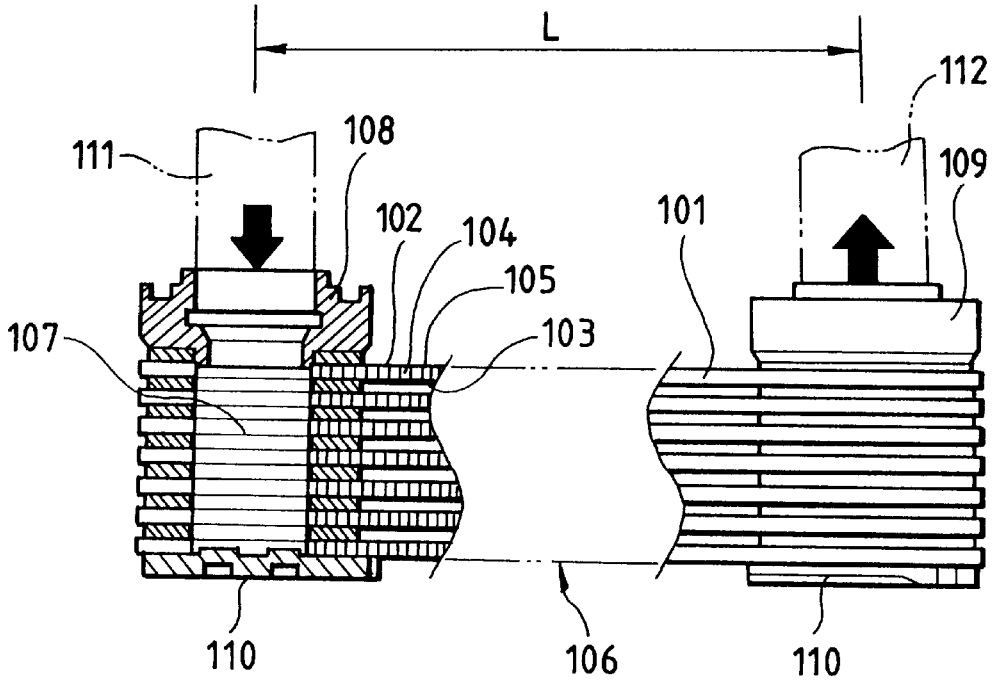
FIG. 25 is a sectional view showing an example of a laminate type oil cooler.

FIGS. 23 and 24 show the details of main parts of the laminate type oil cooler according to a tenth embodiment of the present invention. In this embodiment, a bottom surface portion 63*b* is formed in the annular reinforcing member 63A.

this bottom surface portion 63*b* abuts on the first plate member 23 of an adjacent shell 21.

Incidentally, in this embodiment, the same parts as those in the ninth embodiment are referenced correspondingly, and the details thereof will be omitted.

Also in the tenth embodiment, substantially the same effect as those in the ninth embodiment can be obtained.

Further, in the tenth embodiment, because the bottom surface portion 63*b* is formed in the reinforcing member 63A, an adjacent shell 21 can be used as a part of reinforcing member.

Although the tenth embodiment has been described about the case where lock protrusions 25*c* are formed on the second plate member 25 and engagement holes 61*a* are formed in the reinforcing member 61, it is a matter of course that the present invention is not limited to the embodiment but may be applied to the case where engagement holes are formed in the second plate member and lock protrusions are formed on the reinforcing member.

Although the embodiments have been described about the case where the first and second connectors 39 and 41 are used as oil inflow and oil outflow connectors respectively, it is a matter of course that the present invention is not limited to the embodiments, but may be applied to the case where the first and second connectors 39 and 41 are used as oil outflow and inflow connectors respectively. In this case, the flow of oil is reversed.

Although the aforementioned embodiments has been described about the case where each of the blocking members 51 is shaped like a horseshoe, the present invention is not limited to the embodiment but may be applied to the case where, for example, each of the blocking members is shaped like a rectangle simply and is disposed between the third oil passage hole 37 and the first oil passage hole 33.

Although the laminate type oil cooler in the aforementioned embodiment is used as a water-cooling laminate type oil cooler received in a tank of a radiator in use, the present invention is not limited to the embodiments, but may be applied, for example, to an air-cooling laminate type oil cooler.

Although the embodiments have been described about the case where the third oil passage hole 37 is formed so as to pierce four shells 21, the present invention is not limited to the embodiments, but may be applied to the case where the third oil passage hole is formed, for example, only in one shell 21 connected to the first connector 39. That is, the third oil passage hole may be formed in at least one layer of shell.

As described above, in the structure for mounting an oil cooler to a heat exchanger tank according to the present invention, a support portion for supporting the other side of the oil cooler having no pipe portion formed is formed on an inner surface of the tank. Accordingly, the oil cooler can be supported to the tank securely even in the case where pipe portions are disposed only on one side of the oil cooler.

Further, a protrusion portion is formed on the other side of the oil cooler so as to be fitted to the support portion. Accordingly, the oil cooler can be supported to the tank more securely.

As described above, in the laminate type oil cooler according to the present invention, first and second oil passage holes are formed in the core portion at one and the other side ends thereof, respectively, so that adjacent ones of the shells are communicated with each other. A third oil passage hole is formed in the core portion on the inside of the one side end and in the shells located on one side of the core portion. A first connector communicated with the third oil passage hole and a second connector communicated with the first oil passage hole are disposed on the core portion. And blocking members for blocking the oil flow paths are disposed in the shells having the third oil passage hole formed therein and between the third oil passage hole and the first oil passage hole. Accordingly, the connector for oil inflow and the connector for oil outflow can be disposed on one side of the core portion easily so as to be close to each other.

Further, the shells, the first connector, the second connector and the blocking members are made of aluminum and brazed with one another. Accordingly, these members can be bonded to one another easily and securely.

Further, in the laminate type oil cooler according to the present invention, a reinforcing member is disposed in a position of extension of the oil passage hole between the innermost shell having the oil passage hole formed therein and a shell adjacent to the innermost shell and having no oil passage hole. Accordingly, the second plate member of the innermost shell is supported, through the reinforcing member, by the adjacent shell having no oil passage hole, directly or indirectly through beads, or the like. Accordingly, when the oil passage hole is formed so as to pierce apart of the shells from one surface side of the core portion, the innermost shell can be prevented easily and securely from being deformed.

A reinforcing member is fixed to the second plate member located on the inside of the innermost shell having the oil passage hole formed only in the first plate member. Accordingly, the reinforcing member can be located in a predetermined position securely.

Further, a through-hole is formed in a position of extension of the oil passage hole of the second plate member located on the inside of the innermost shell having the oil passage hole formed only in the first plate member. Accordingly, an adjacent shell may be used as a reinforcing member.

Still further, the annular reinforcing member is bottomed. Accordingly, an adjacent shell can be used as a part of reinforcing member.

Although the invention has been described in its preferred formed with a certain degree of particularity, it is understood that the present disclosure of the preferred form can be changed in the details of construction and in the combination and arrangement of parts without departing from the spirit and the scope of the invention as hereinafter claimed.

What is claimed is:

1. A laminate type oil cooler comprising:

a core portion in which a plurality of shells each having an oil flow path formed therein are laminated;

a first oil passage hole being formed at a first side end of said core portion;

a second oil passage hole being formed at a second side end of said core portion so that laminated shells are made to communicate with each other by said first and second oil passage holes;

a third oil passage hole being formed between said first oil passage hold and said second oil passage hole in a width direction of said core portion so that only a part of all laminated shells in a lamination direction of said shells are made to communicate with each other by said third oil passage hole; and a blocking member being disposed in said oil flow path of said shell having said third oil passage hole so as to block oil flow, said blocking member being disposed between said third oil passage hole and said first oil passage hole.

2. A laminate type oil cooler according to claim 1, wherein said shell comprises a first plate member, a second plate member, and an inner fin, said oil flow path is formed between said first and second plate members, and said inner fin is received in said oil flow path, and wherein said third oil passage hole is formed only in said first plate member located on an outer side of an innermost shell disposed at an innermost of said third oil passage hole.

* * * * *

UNITED STATES PATENT AND TRADEMARK OFFICE

CERTIFICATE OF CORRECTION

PATENT NO. : 6,082,449
DATED : July 4, 2000
INVENTOR(S) : Takeshi Yamaguchi et al.

It is certified that error appears in the above-identified patent and that said Letters Patent is hereby corrected as shown below:

Please reinstate claims 11-18 of the application as follows, which claims are renumbered in correspondence with their dependency on patent claims 1 and 2:

--3. A laminate type oil cooler according to claim 2, further comprising a reinforcing member disposed in a position of extension of said third oil passage hole as well as between said innermost shell and one shell adjacent to said innermost shell having no third oil passage hole.

4. A laminate type oil cooler according to claim 3, wherein said reinforcing member is fixed to said second plate member located on an inner side of said innermost shell.

5. A laminate type oil cooler according to claim 4, wherein a lock protusion is protruded from said second plate member toward said reinforcing member, and an engagement hole is formed in said reinforcing member so that said lock protrusion is inserted into said engagement hole.

6. A laminate type oil cooler according to claim 3, wherein a bead is formed so as to be protruded from said first plate member of said one shell adjacent to said innermost shell in the position of extension of said third oil passage hole, and said reinforcing member is disposed between said second plate member of said innermost shell and said bead, whereby a thickness of said reinforcing member is reduced by a height of said bead.

UNITED STATES PATENT AND TRADEMARK OFFICE

CERTIFICATE OF CORRECTION

PATENT NO. : 6,082,449
DATED : July 4, 2000
INVENTOR(S) : Takeshi Yamaguchi et al.

It is certified that error appears in the above-identified patent and that said Letters Patent is hereby corrected as shown below:

7. A laminate type oil cooler according to claim 3, wherein a through-hole is formed in said second plate member of said innermost shell in the position of extension of said third oil passage hole, and an annular reinforcing member is disposed in a position on an outside of said through-hole.

8. A laminate type oil cooler according to claim 7, wherein said annular reinforcing member is bottomed.

9. A laminate type oil cooler according to claim 3, further comprising:
a plurality spacers disposed on opposite sides of said shells;
an annular spacer disposed in a position of an outside of said third oil passage hole as well as between said shells having said third oil passage hole formed therein, wherein cooling gaps are formed between said shells.

10. A laminate type oil cooler according to claim 9, wherein said blocking member, said first and second plate members, said inner fins, said spacers, said annular spacers and said reinforcing member are made of aluminum and brazed with one another.--

Signed and Sealed this

Thirty-first Day of July, 2001

Nicholas P. Godici

*Attest:*

*Attesting Officer*

NICHOLAS P. GODICI
*Acting Director of the United States Patent and Trademark Office*